US009315983B1

(12) United States Patent
Sedehi

(10) Patent No.: US 9,315,983 B1
(45) Date of Patent: Apr. 19, 2016

(54) MODULAR OBSERVATORY AND AN UNASSEMBLED KIT THEREOF

(71) Applicant: Canadian Telescopes Inc., Burnaby (CA)

(72) Inventor: Babak Sedehi, Burnaby (CA)

(73) Assignee: Canadian Telescopes Inc., Burnaby (CA)

( * ) Notice: Subject to any disclaimer, the term of this patent is extended or adjusted under 35 U.S.C. 154(b) by 0 days.

(21) Appl. No.: 14/739,794

(22) Filed: Jun. 15, 2015

(51) Int. Cl.

| | |
|---|---|
| ***E04B 7/08*** | (2006.01) |
| ***E04B 1/32*** | (2006.01) |
| ***E04H 3/00*** | (2006.01) |
| ***E04B 1/02*** | (2006.01) |
| ***E04B 1/346*** | (2006.01) |
| ***E04B 7/10*** | (2006.01) |
| ***E04B 7/16*** | (2006.01) |
| *E04B 1/343* | (2006.01) |

(52) U.S. Cl.
CPC ..... *E04B 1/3211* (2013.01); *E04B 1/02* (2013.01); *E04B 1/346* (2013.01); *E04B 7/102* (2013.01); *E04B 7/16* (2013.01); *E04H 3/00* (2013.01); *E04B 2001/327* (2013.01); *E04B 2001/3276* (2013.01); *E04B 2001/3288* (2013.01); *E04B 2001/3294* (2013.01); *E04B 2001/34389* (2013.01)

(58) Field of Classification Search
CPC ..... E04B 1/3211; E04B 2001/3276; E04B 2001/3294; E04B 7/102; E04B 2001/3288
USPC ..... 52/80.1, 81.1, 81.4, 81.5, 80.2
See application file for complete search history.

(56) References Cited

U.S. PATENT DOCUMENTS

| | | | | |
|---|---|---|---|---|
| 416,364 | A | 12/1889 | Hough et al. | |
| 535,990 | A | 3/1895 | Lowe | |
| 2,080,786 | A | 5/1937 | Robles | |
| 2,180,504 | A | 11/1939 | Bradfield et al. | |
| RE22,693 | E | 11/1945 | Lindsay | |
| 2,428,839 | A | 10/1947 | Salino | |
| 2,944,370 | A * | 7/1960 | Malarkey | E04B 1/3211 220/4.28 |
| 2,996,844 | A | 8/1961 | Paulson | |
| 3,213,571 | A | 10/1965 | Olson | |

(Continued)

FOREIGN PATENT DOCUMENTS

| | | |
|---|---|---|
| EP | 0152715 | 9/1989 |
| GB | 2232695 | 12/1990 |
| WO | 2007143829 | 12/2007 |

OTHER PUBLICATIONS

English Abstract of EP 0152715.

*Primary Examiner* — Chi Q Nguyen
(74) *Attorney, Agent, or Firm* — Cameron IP

(57) ABSTRACT

There is provided a modular observatory including an annular wall assembly and a roof assembly selectively engageable with the wall assembly. The assemblies include a plurality of interengageable panels. The panels of the wall assembly are generally curved and rectangular. A set of the panels of the roof assembly are generally curved and rectangular in shape. Selective ones of the panels of the roof assembly are removeable to form an elongate opening in the top thereof. There is further provided an unassembled modular observatory kit comprising a plurality of interengageable wall panels, each of which is similar in size and curved and rectangular in profile. The kit includes a plurality of interengageable roof panels, a first set of which are similar in size and curved and rectangular in profile and a second set of which are similar in size and curved and triangular in profile.

20 Claims, 17 Drawing Sheets

(56) References Cited

U.S. PATENT DOCUMENTS 3,245,178 A 4/1966 Clark
3,284,969 A * 11/1966 Walters ..... E04B 1/3211 52/578
3,296,755 A 1/1967 Chisholm
3,359,682 A 12/1967 Clark
3,387,356 A 6/1968 Clark
3,513,608 A 5/1970 Nagrod
3,524,292 A 8/1970 Bottom
3,921,555 A * 11/1975 Suzuki ..... E04H 7/14 228/138
3,946,567 A 3/1976 Oger
4,023,317 A * 5/1977 Bettger ..... E04B 1/32 52/262
4,063,393 A 12/1977 Toti
4,068,421 A 1/1978 Marovich
4,092,810 A 6/1978 Sumner
4,306,390 A 12/1981 Brown
4,440,376 A * 4/1984 Peterson ..... E02D 29/00 249/18
D275,888 S 10/1984 Lauer et al.
4,531,333 A 7/1985 Huegy
4,665,664 A * 5/1987 Knight ..... E04B 1/3211 52/81.5
4,754,583 A * 7/1988 Jenn ..... E04B 7/107 52/300
4,784,172 A * 11/1988 Yacoboni ..... E04B 1/3211 135/87
4,848,046 A * 7/1989 Wallhead ..... E04H 9/16 52/81.4
4,907,383 A 3/1990 Winter, IV
4,918,881 A 4/1990 Cottle et al.
5,377,460 A * 1/1995 Hicks ..... E04B 1/3211 52/80.1
5,448,860 A 9/1995 Menke et al.
5,715,854 A * 2/1998 Andrieux ..... E04H 15/001 135/94
5,724,775 A 3/1998 Zobel, Jr. et al.
5,881,896 A 3/1999 Presnell et al.
6,912,488 B1 6/2005 Saebi
8,033,060 B2 10/2011 Parker et al.
8,365,474 B2 2/2013 McSweeney
2005/0086875 A1* 4/2005 Holler ..... B63B 1/12 52/79.1
2007/0199254 A1 8/2007 Luburic

* cited by examiner

MODULAR OBSERVATORY AND AN UNASSEMBLED KIT THEREOF

BACKGROUND OF THE INVENTION

1. Field of the Invention

There is provided an observatory. In particular, there is provided a modular observatory and an unassembled kit thereof.

2. Description of the Related Art

Traditionally, observatories have been relatively heavy. This may result in observatories that are difficult to move. This may further result in observatories that are expensive to transport due to weight considerations, thereby inhibiting the accessibility of observatories for personal use.

Observatories have also traditionally been relatively bulky, due to the cumbersome nature of their dome-like structures. The relative sizes and shapes of such observatories may thus render such systems yet more difficult to transport in a cost-effective, space-saving manner.

There is accordingly a need for an improved observatory.

BRIEF SUMMARY OF INVENTION

There is provided an improved observatory disclosed herein that overcomes the above disadvantages.

There is accordingly provided a modular observatory. The observatory includes an annular wall assembly and a roof assembly selectively engageable with the wall assembly. Each of the assemblies includes a plurality of interengageable panels. The panels of the wall assembly are generally curved and rectangular. A set of the panels of the roof assembly are generally curved and rectangular in shape.

There is also provided a modular, dome-like roof assembly for an observatory. The roof assembly has opposite sides, a front, a rear, a bottom and a top. The front and the rear of the roof assembly extend between the sides thereof. The front, rear and sides of the roof assembly extend from the bottom towards the top thereof. The roof assembly includes a plurality of interengageble panels which connect together via peripheral edge portions thereof shaped to interfit with each other. The panels are shaped such that selective ones of the panels are removeable to form an elongate opening in the top of the roof assembly. The elongate opening extends from the front towards the rear of the roof assembly and between the sides of the roof assembly.

There is further provided an unassembled modular observatory kit. The kit includes a plurality of interengageable wall panels, each of which is similar in size and curved and rectangular in profile. The kit includes a plurality of interengageable roof panels, a first set of which are similar in size and curved and rectangular in profile and a second set of which are similar in size and curved and triangular in profile.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
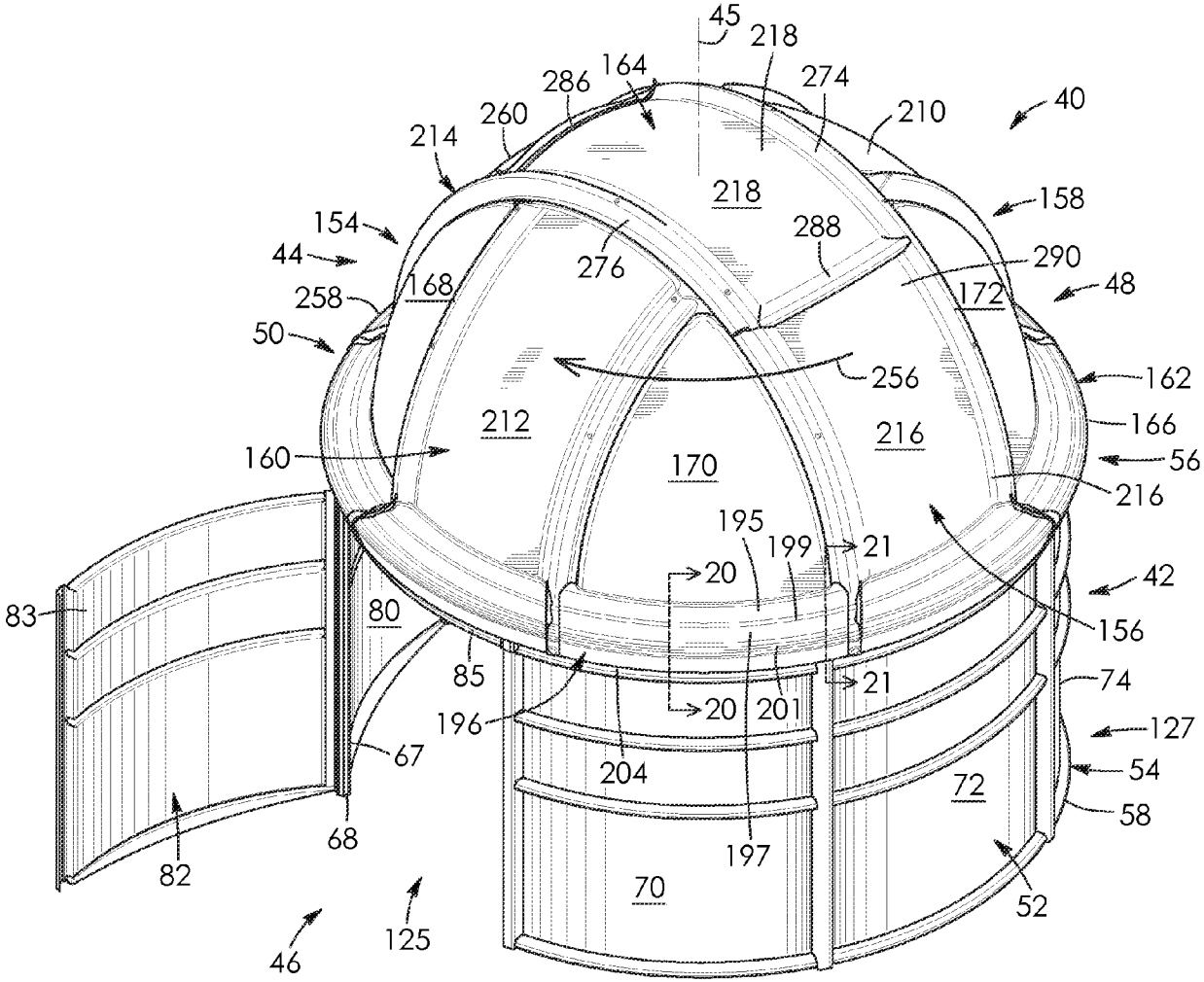
FIG. 1 is a top, side perspective view of a modular observatory according to one aspect, the observatory including a wall assembly and a roof assembly, with each of the assemblies comprising a plurality of interengageable panels, with a door panel of the wall assembly being shown angled in an open position.

Referring to the drawings and first to FIG. 1, there is shown a modular observatory 40. The observatory includes a modular wall assembly 42 and a modular roof assembly 44 selectively engageable with the wall assembly.

Figure 7:
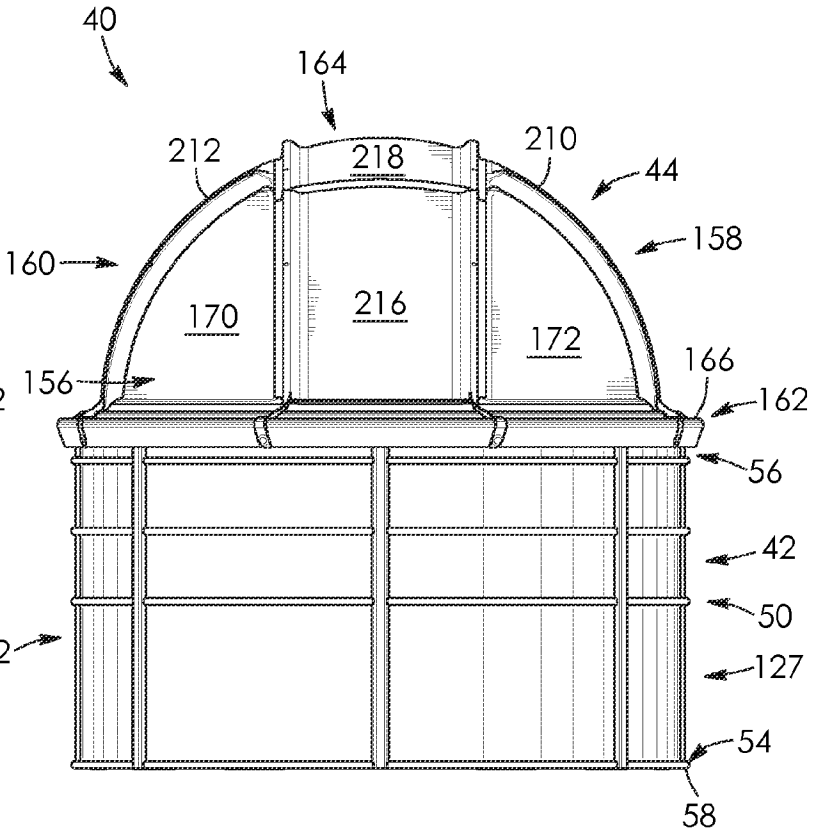
FIG. 7 is a rear elevation view thereof.
Figure 6:
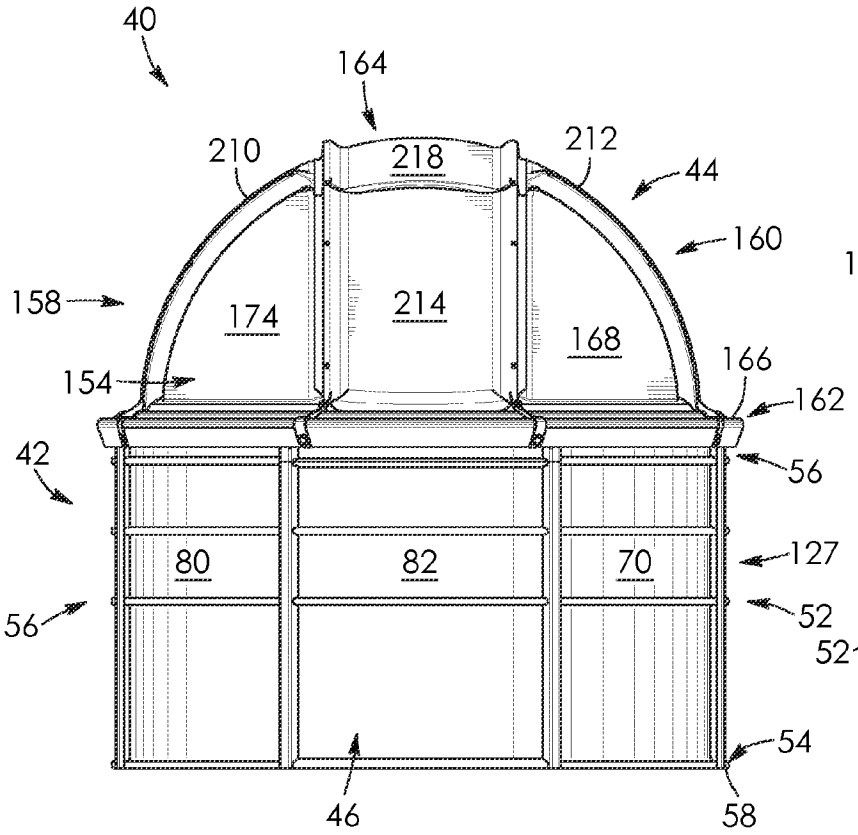
FIG. 6 is a front elevation view thereof.
Figure 9:
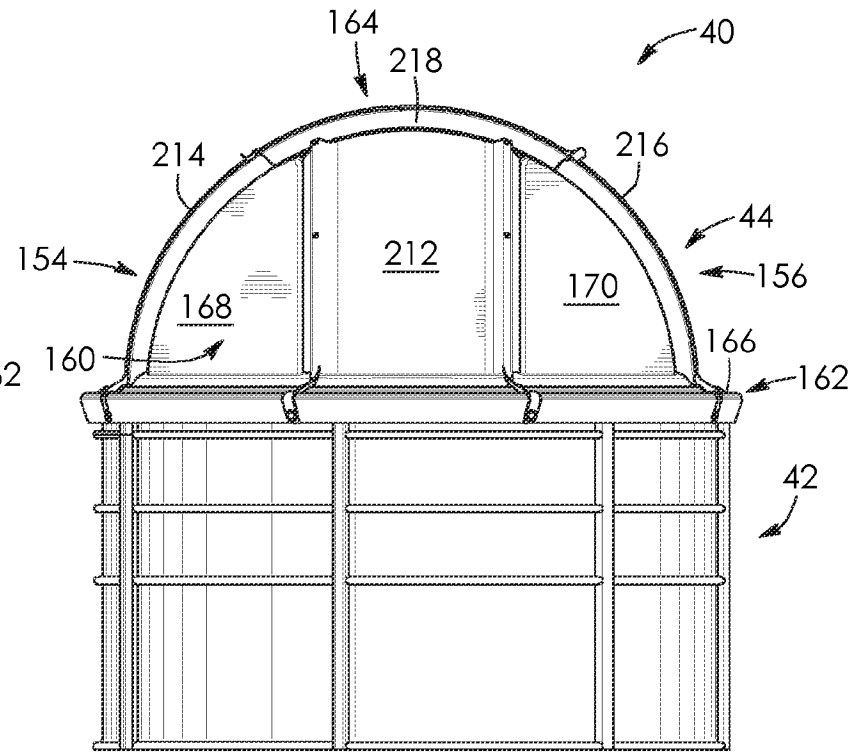
FIG. 9 is a second side elevation view thereof which is opposite the first side elevation view of FIG. 8.
Figure 8:
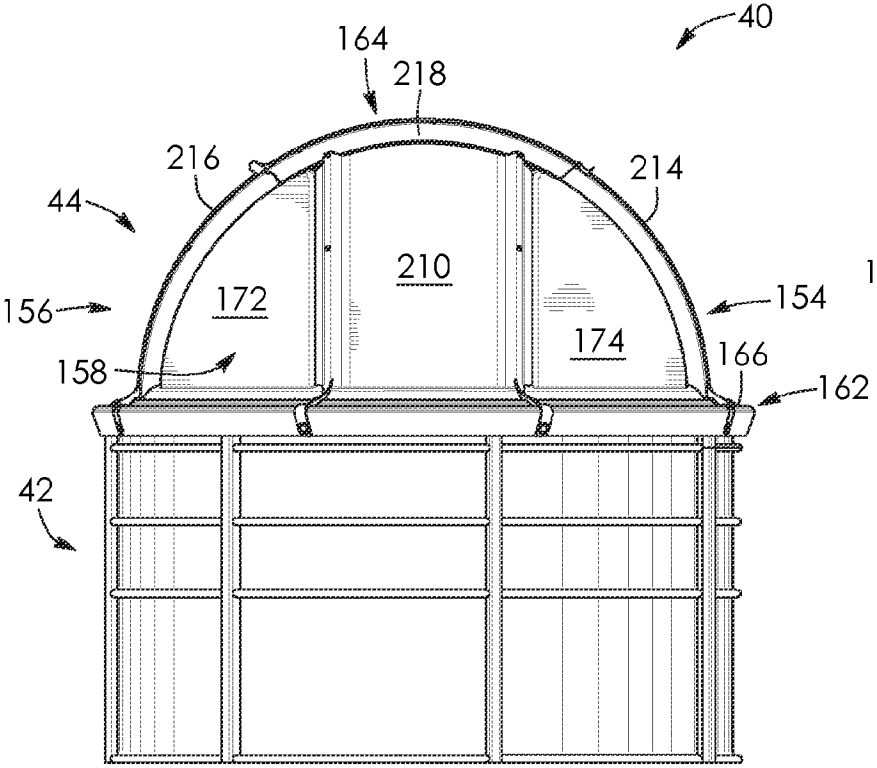
FIG. 8 is a first side elevation view thereof.
Figure 12:
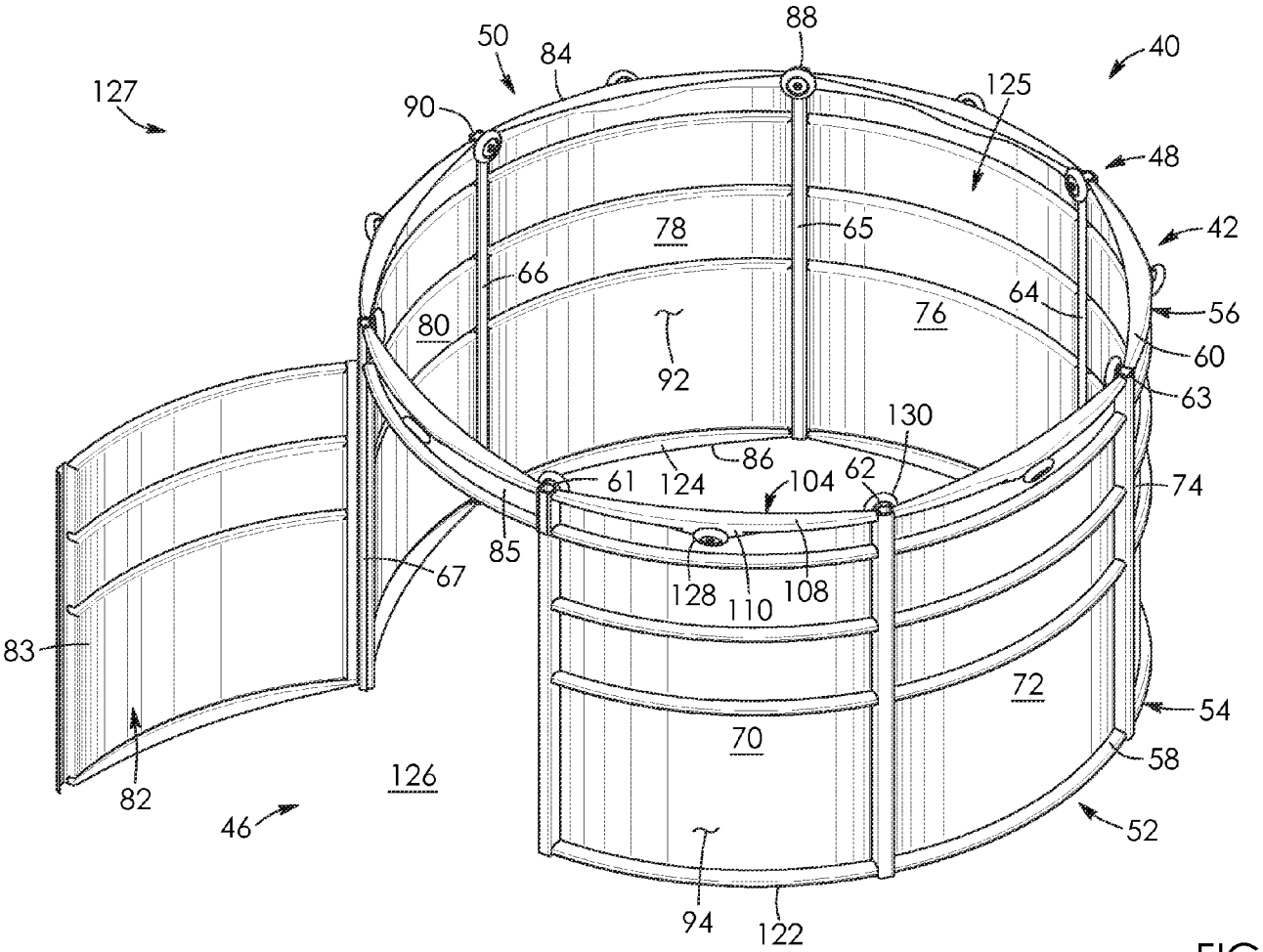
FIG. 12 is a top, front perspective view of the wall assembly of the observatory of FIG. 1 fully assembled and with the roof assembly not shown.

The wall assembly is generally annular in shape in this example. The wall assembly 42 has a front 46 best seen in FIG. 6 and a rear 48 best seen in FIG. 7 which is spaced-apart from the front. The wall assembly has opposite sides, namely a first side 50 best seen in FIG. 8 and a second side 52, best seen in FIG. 9, which is interposed between the front and rear thereof. As best seen in FIG. 12, the wall assembly includes a bottom 54 and a top 56 spaced-apart from the bottom. The top and bottom of the wall assembly 42 are generally circular in shape in this example. As seen in FIG. 1, the front 46, rear 48 and sides of the wall assembly 42 extend between the bottom 54 and top 56 thereof. The wall assembly 42 includes a lower peripheral edge portion 58 adjacent to the bottom thereof and an upper peripheral edge portion 60, best seen in FIG. 12, adjacent to the top thereof.

Figure 10:
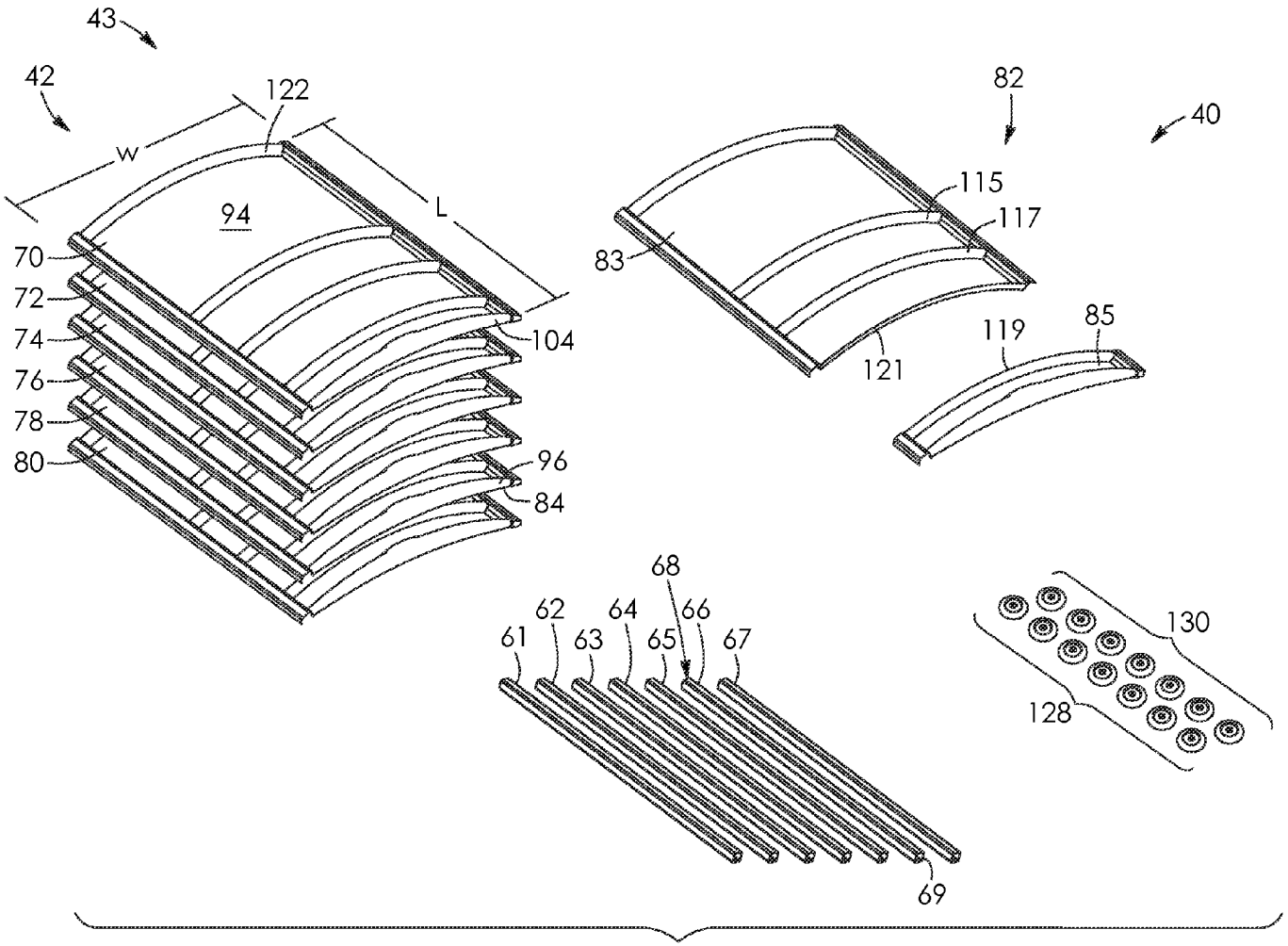
FIG. 10 is a top perspective view of the wall assembly of the observatory of FIG. 1, the wall assembly being shown in unassembled form.
Figure 11:
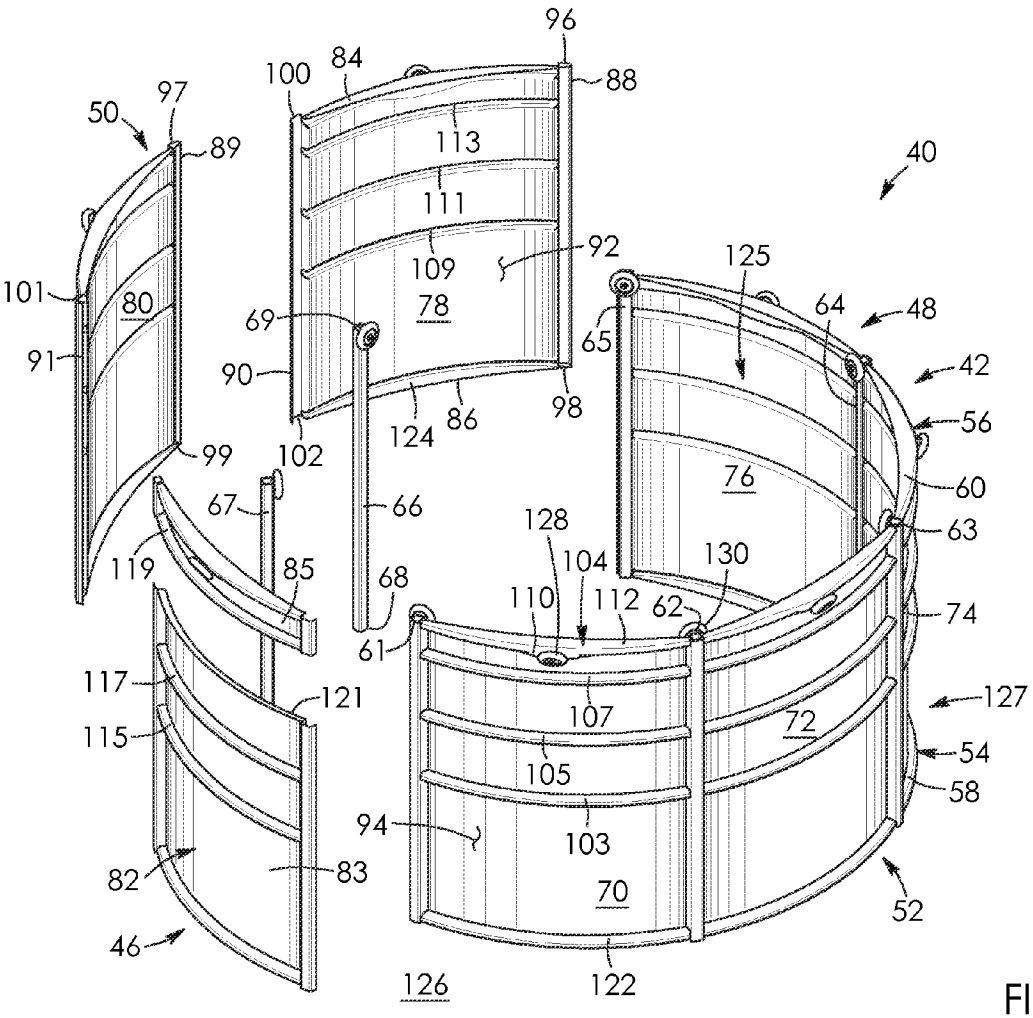
FIG. 11 is a top, front perspective and partially exploded view of the wall assembly of the observatory of FIG. 1 in the process of being connected together and with the roof assembly not shown.

As seen in FIG. 10, the wall assembly includes a plurality of upright members, in this example in the form of seven posts 61, 62, 63, 64, 65, 66 and 67. Each of the posts is tubular and rectangular in cross-section in this example, though this is not strictly required. Each of the posts has a bottom end and a top end opposite the bottom end, as seen in FIG. 11 by bottom end 68 and top end 69 for post 66. As seen in FIG. 11, each of the posts 61, 62, 63, 64, 65, 66 and 67 is positionable in a spaced-apart and generally circular arrangement such that their bottom ends align with the ground and their tops ends extend upwards therefrom.

Referring back to FIG. 10, the wall assembly 42 includes a plurality of interengageable panels including a series of side panels, in this example six side wall panel 70, 72, 74, 76, 78 and 80, and a door panel 82. While the wall assembly 42 includes six side wall panels in this example, this number is not strictly required and the assembly may include additional or fewer side panels in other embodiments. Each of the panels 70, 72, 74, 76, 78, 80 and 82 is substantially the same in shape with the exception that door panel 82 is split into two parts: an upper part 83 and a lower part 85.

The panels of the wall assembly are generally curved and rectangular in shape and similar in shape with each other. The panels have lengths L and widths W that are substantially equal in size in this example. In this example, each of the panels 72, 74, 76, 78, 80 and 82 of the wall assembly is curved and outwardly convex in a direction extending along its width.

As seen in FIG. 11, each of the panels includes a top aligning with the upper peripheral edge portion 60 of the wall assembly 42, a bottom spaced-apart from its top and aligning with the lower peripheral edge portion 58 of the wall assembly, and a pair of spaced-apart, longitudinally-extending peripheral edge portions extending between its top and bottom, as shown by top 84, bottom 86 and peripheral edge portions 88 and 90 for panel 78. Peripheral edge portions 89 and 91 are shown for panel 80. Each of the panels of the wall assembly further includes a generally-rectangular interior side facing respective other panels when the wall assembly is assembled. Each panel also has a generally-rectangular exterior side opposite its interior side, as seen by interior side 92 for panel 78 and exterior side 94 for panel 70. The sides of the panels extend between their tops and bottoms and between their longitudinally-extending peripheral edge portions. Referring to FIG. 12, each of the panels is shaped to extend between and abut with adjacent pairs of posts, as seen by panel 78 extending between posts 65 and 66 and peripheral edge portions 88 and 90 thereof operatively said posts.

The longitudinally-extending peripheral edge portions 88, 89, 90 and 91 of the panels 78 of the wall assembly 42 are channel-shaped, in this example being u-shaped cross-section. The peripheral edge portions of the panels extend outwards from the interior sides 92 towards the exterior sides 94 of the panels in this example. Also in this example, first ones 88 and 89 of the peripheral edge portions of each of the respective ones of the panels 78 and 80 are channel-shaped with closed ends 96 and 97 and 98 and 99 at the tops 84 and bottoms 86 of the panels, respectively. Second ones 90 and 91 of the peripheral edge portions of each of the panels 78 and 80 are channel-shaped with open ends 100 and 101 and 102 at the tops and bottoms of the panels, respectively, in this example.

Peripheral edge portions 90 and 91 of each of the panels 78 and 80 are shaped to partially extend around and receive respective ones of the posts 66 and 67, with their open ends 100, 101 and 102 aligning with the top and bottom ends of the posts.

Peripheral edge portions 89 of the panels 80 are shaped to partially extend around respective ones of peripheral edge portions 100 from adjacent panels 78 so abutting posts 66. Closed ends 97 and 99 of the peripheral edge portions 89 of the panels align with and extend overtop of open ends 100 and 102 of the peripheral edge portions 100. The closed ends also align with and at least partially extend overtop of top ends 69 and bottom ends 68 of the posts 66. The wall panels 70, 72, 74, 76, 78, 80 and 82 may thus be said to have longitudinally-extending peripheral edge portions shaped to interfit with each other. As seen in FIG. 12, the panels are shaped such that when they are so interfitted, they form an assembly that is annular when the wall panels are fully assembled. The wall assembly 42 so fully assembled has a cylindrical interior 125 which the interior sides 92 of the wall panels face and has an exterior 127 which the exterior sides 94 of the wall panels face.

As seen in FIG. 11, each of the panels includes a plurality of spaced-apart intermediate flanges, in this example three flanges which extend between its top and bottom and which are interposed and extend between their peripheral edge portions. This is seen is by flanges 103, 105 and 107 for panel 70. The flanges extend outwards from the exterior sides 94 of the panels and are v-shaped in cross-section in this example. The panels have elongate channels at locations opposite the flanges, as seen by channels 109 and 111 and 113, extending outwards from interior sides 92 of panels 78.

As seen in FIG. 10, panel 82 has two parts 83 and 85. Upper intermediate flange 119 is on part 85 and is adjacent to part 82 when the panel is assembled. As seen in FIG. 11, flange 119 of panel 82 is shaped to abut upper peripheral edge 121 of part 83 of the panel in this example.

Outer lower flanges and inner lower flanges extend radially inwards and outwards from the exterior and interior sides of the panels, respectively adjacent to the bottoms thereof in this example, as seen by outer lower flange 122 for panel 70 and inner lower flange 124 for panel 78. The lower flanges are shaped to extend between respective ones of the longitudinal peripheral edge portions of the panels and are shaped to abut and extend along the ground 126. Outer lower flanges 122 are arcuate-shaped in this example and inner lower flanges are circle segments in shape in this example.

Figure 20:
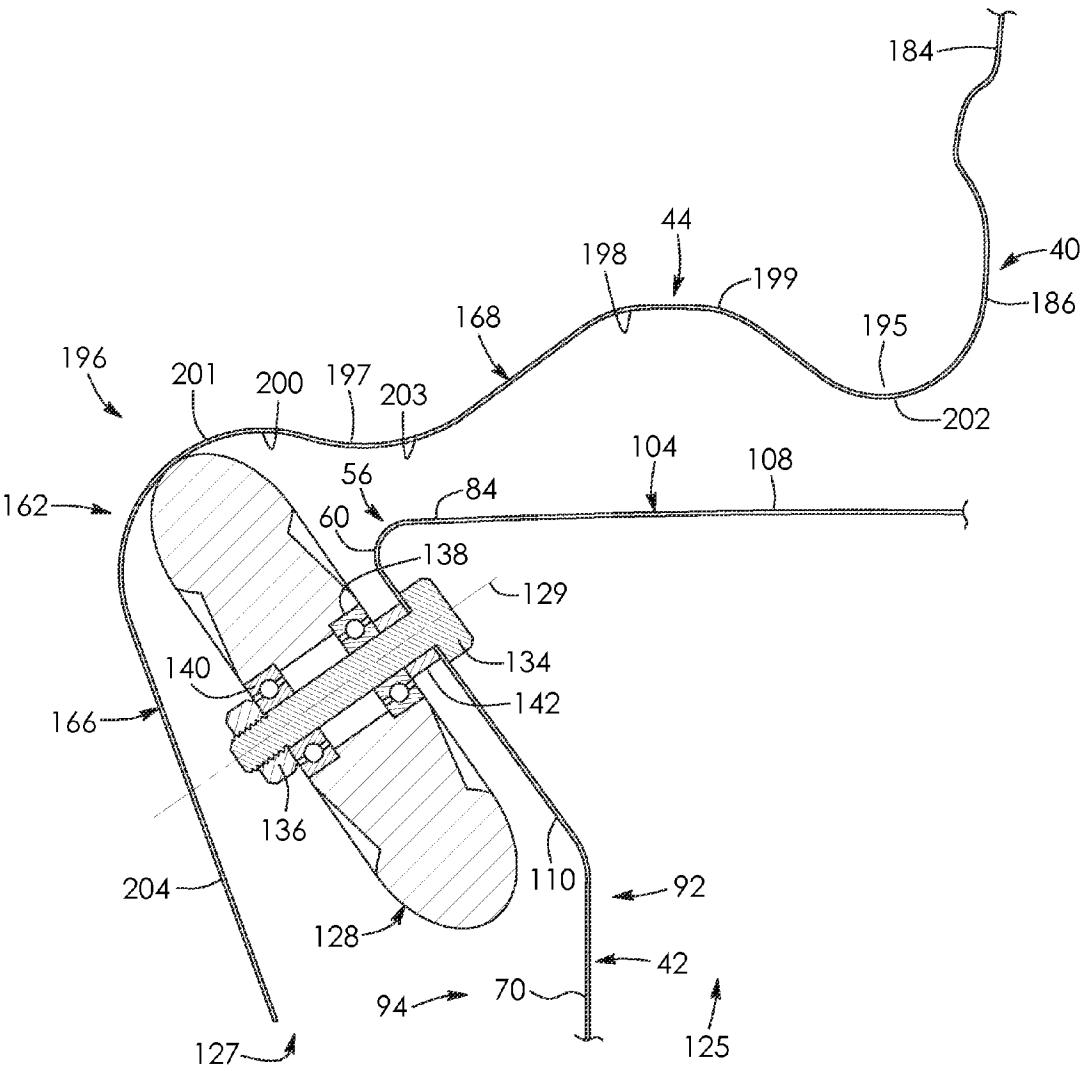
FIG. 20 is a cross-sectional view taken along lines 20-20 of FIG. 1 of a corner panel of the roof assembly and a wall panel of the wall assembly of FIG. 1 shown rotatably connected to each other.

Upper flanges 104 of the panels extend outwards from the exterior sides 94 of the panels and are v-shaped in cross-section in this example. As best seen in FIG. 20, each of the flanges 104 has a horizontally-extending upper portion 108 and a downwardly-facing angled portion 110 coupled to and angled relative to said upper portion.

Referring to FIG. 10, the wall assembly 42 includes a plurality of rotatable members, in this example a plurality of rollers in the form of a first set of rollers 128 and a second set of rollers 130. However, rollers are not strictly required and other rotatable members are possible in other embodiments, such as bearings, wheels and the like, for example. As seen in FIG. 12, the first set of rollers 128 are selectively rotatably connectable to the panels 70, 72, 74, 76, 78, 80 and 82 via angled portions 110 of upper flanges 104. This is best seen in FIG. 20 in which roller 128 pivotally connects to panel 70 via an axle, in this example a bolt 134. The bolt and a nut 136 operatively couple the roller to angled portion 110 of flange 124, with the roller connecting to the bolts via spaced-apart inner and outer bearings 138 and 140 in this example. Annular spacers 142 may extend around bolts 134, may be interposed between flanges 104 and bearing 138, and may thus cause the rollers 128 to be spaced-apart from flanges 104. Each of the rollers 128 has an axis of rotation 129 co-axial with the longitudinal axis of its bolt 134 in this example and which extends outwardly and downwards from the upper peripheral edge portion 60 of the assembly 42. As seen in FIG. 12, the rollers 128 are coupled to the panels 70, 72, 74, 76, 78, 80 and 82 such that they face the exterior 127 of the wall assembly 42 in this example, are angled downwards towards the ground 126 and are angled outwards from the assembly in this example.

Figure 21:
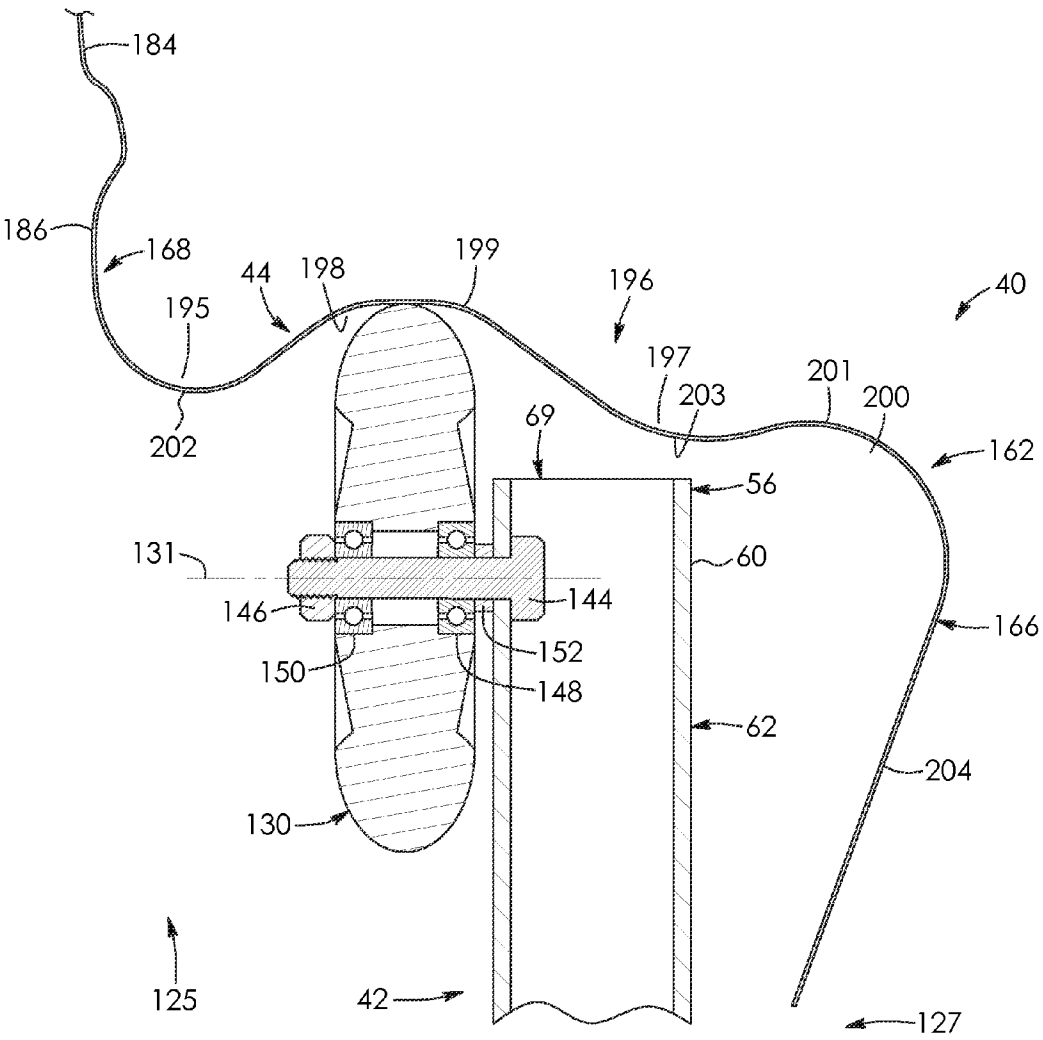
FIG. 21 is a cross-sectional view taken along lines 21-21 of FIG. 1 of a corner panel of the roof assembly and a post of the wall assembly of FIG. 1 shown rotatably connected to each other.

Referring back to FIG. 10, each of the rollers 130 is configured to rotatably couple to one of the posts adjacent to a top end thereof. This is seen in FIG. 21 by roller 130 rotatably coupling to top end 69 of post 62. Roller 130 pivotally connects to the post via an axle, in this example a bolt 144. The bolt and a nut 146 operatively couple the roller to the post, with the roller connecting to the post via spaced-apart inner and outer bearings 148 and 150 in this example. Annular spacers 152 may extend around bolts 144, may be interposed between the posts and bearing 148, and may thus cause the rollers 130 to be spaced-apart from posts 62. Each of the rollers 130 has an axis of rotation 131 co-axial with the longitudinal axis of its bolt 144 in this example and which extends in a substantially horizontal direction in this example.

The above described roller connection mechanisms are examples only and other mechanisms for rotatably coupling the rollers to the upper flanges may be used in other embodiments. Rotatable coupling of rollers to a structure, including their various parts and functions therefor, is well-known to those skilled in the art and therefore will not be described in further detail.

As seen in FIG. 12, the rollers 130 are coupled to the posts 61, 62, 63, 64, 65, 66, and 67 such that they face the interior 125 of the wall assembly 42 in this example and are interposed between respective ones of rollers 128.

Figure 2:
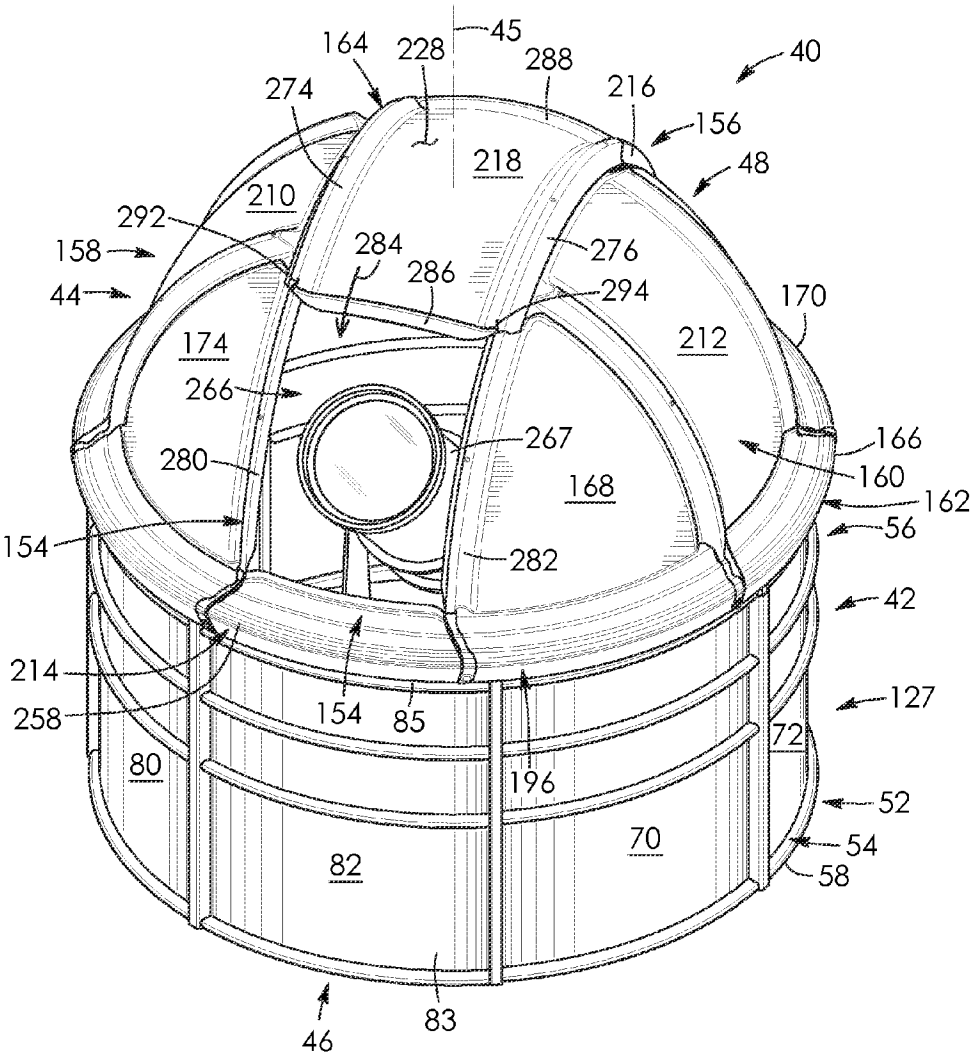
FIG. 2 is a top, front perspective view of the observatory, with the roof assembly being rotated relative to the wall assembly compared to the position of the roof assembly shown in FIG. 1, and with a front panel of the roof assembly being removed.

As seen in FIG. 1, the roof assembly 44 is generally dome shaped in this example and has a central, vertically-extending axis 45 extending therethrough and about which the assembly 44 is configured to rotate. The roof assembly has a front 154 best seen in FIG. 6 and a rear 156 best seen in FIG. 7 which is opposite from the front. The roof assembly 44 has opposite sides, namely a first side 158 best seen in FIG. 8 and a second side 160, best seen in FIG. 9, which is interposed between the front and rear thereof. The roof assembly includes a bottom 162 and a top 164 spaced-apart from the bottom. The front, rear and sides of the roof assembly extend from the bottom towards the top thereof. The bottom of the roof assembly is generally annular in shape in this example. As seen in FIG. 2, the front 154, rear 156 and sides 158 and 160 of the roof assembly 44 extend between the bottom 162 and top 164 thereof. The roof assembly 44 includes a lower peripheral edge portion 166 adjacent to the bottom thereof. Central axis 45 of the roof assembly 44 extends through the top 164 and bottom 162 thereof. The central axis is interposed between the front 154, rear 156 and sides 158 and 160 of the roof assembly.

Figure 13:
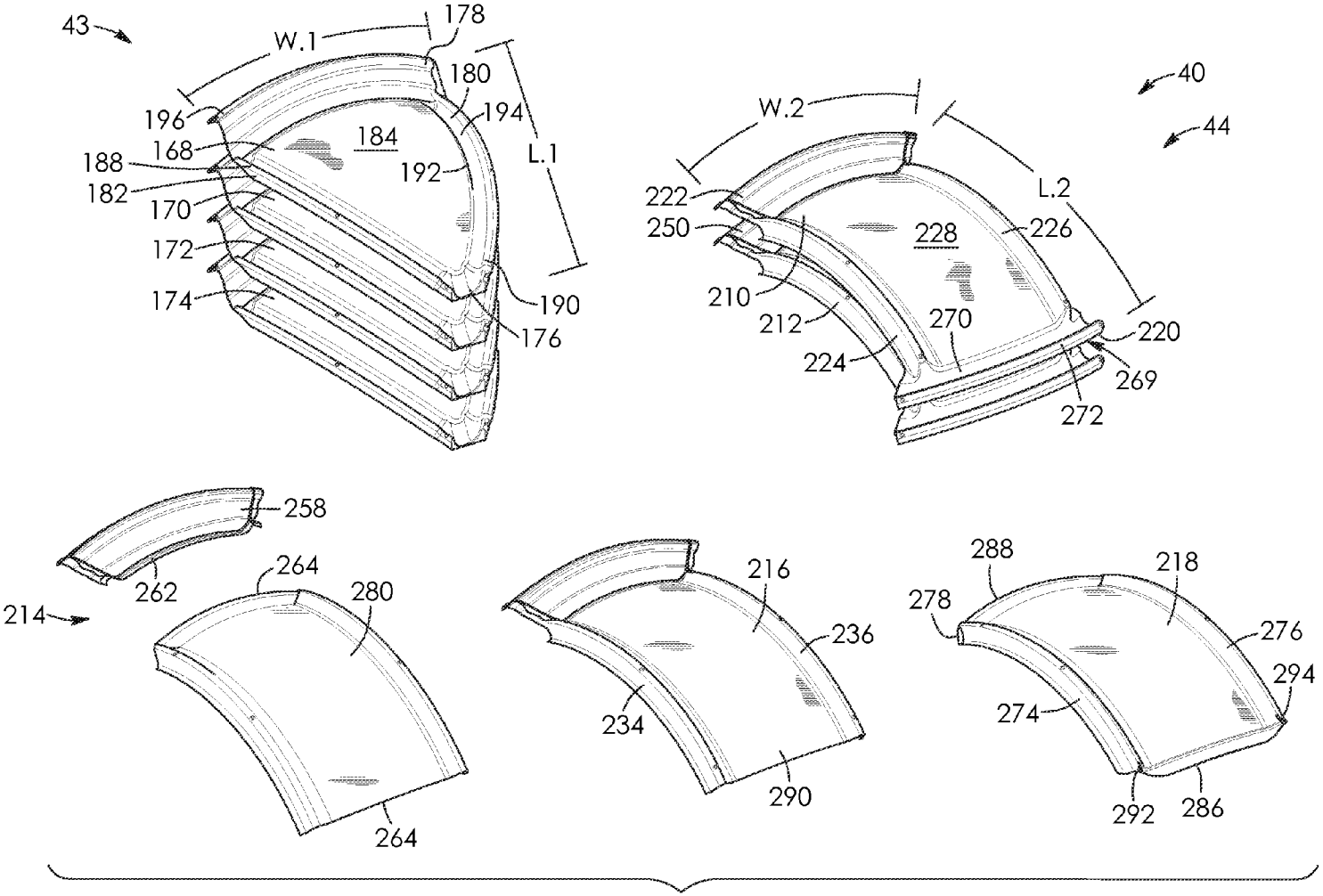
FIG. 13 is a top perspective view of the roof assembly of the observatory of FIG. 1, the roof assembly being shown in unassembled form.

As seen in FIG. 13, the roof assembly includes a plurality of interengageable panels including a first set of four corner panels 168, 170, 172 and 174 in this example. The corner panels are generally curved, outwardly convex and triangular in shape and similar in shape with each other in this example. The panels 168, 170, 172 and 174 have lengths L.1 and widths W.1 that are substantially equal in size to each other. Each of the corner panels of the roof assembly 44 is curved and outwardly convex in a direction extending along its width and is curved and outwardly convex in a direction extending along its length.

Figure 14:
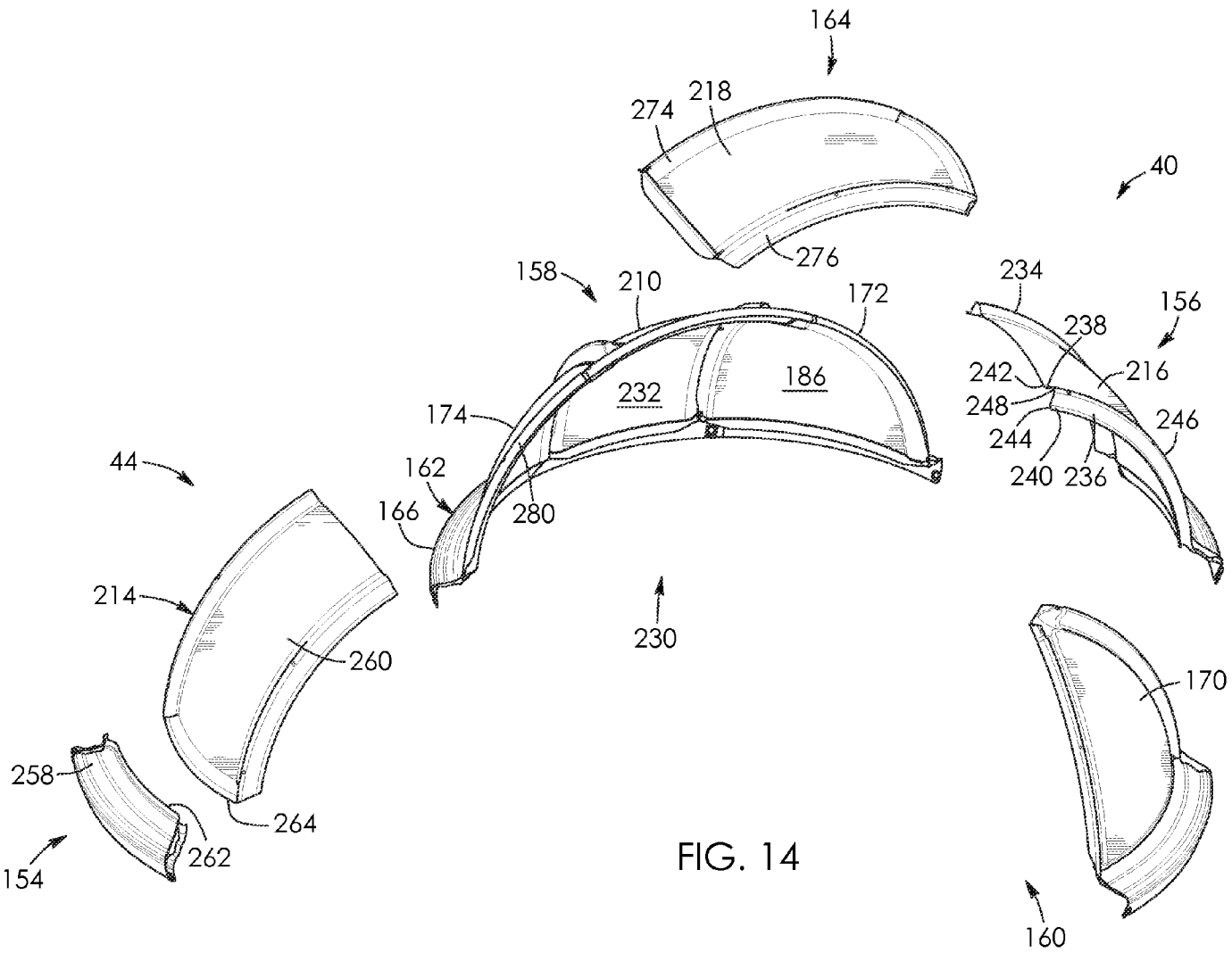
FIG. 14 is a top, front perspective and partially exploded view of the roof assembly of the observatory of FIG. 1 in the process of being connected together and with the wall assembly not being shown.

Each of the corner panels 168, 170, 172 and 174 has a top 176, an elongate bottom 178 which is spaced-apart from its top, a pair of elongate sides 180 and 182 which meet at said top and which extend outwards towards said bottom. Each of the corner panels includes an exterior side which extends between said top, bottom and sides, as seen by exterior side 184 for panel 168. Each of the panels includes an interior side opposite said exterior side and which extends between its top, bottom and sides, as seen in FIG. 14 by interior side 186 for panel 174. The interior and exterior sides of the corner panels are substantially triangle-shaped in this example curved along their lengths and widths.

Figure 18:
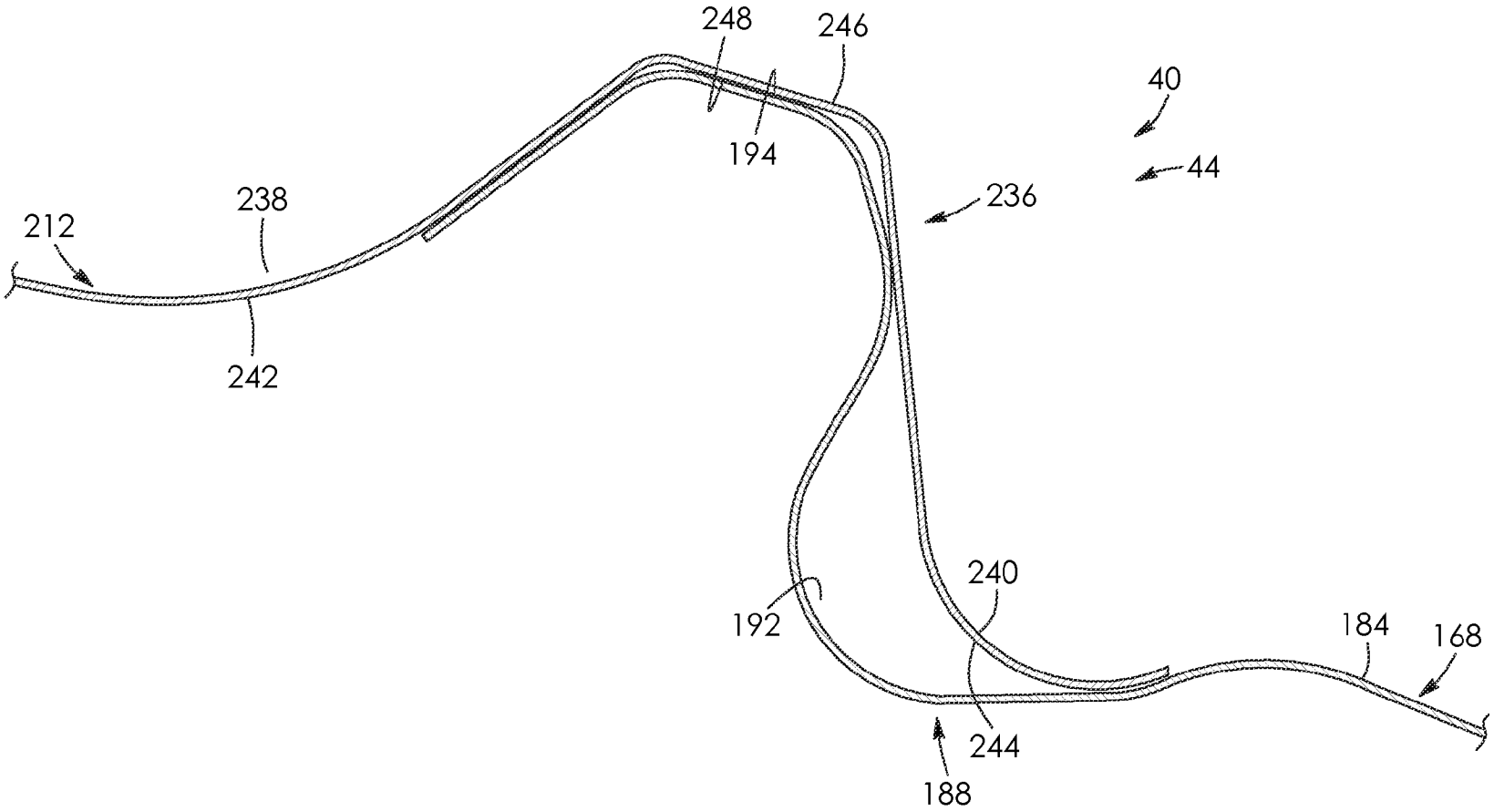
FIG. 18 is a cross-sectional view taken along lines 18-18 of FIG. 17 of the corner and side panel of FIG. 17.

Referring to FIG. 13, each of the corner panels includes a pair of side peripheral edge portions extending along their sides from the top to the bottom thereof, as seen by side peripheral edge portions 188 and 190 for panel 168. As best seen in FIG. 18, each of the side peripheral edge portions 190 of the corner panels 168 is s-shaped in cross-section in this example. Each of the side peripheral edge portions includes an outwardly-facing elongate channel 192 adjacent to and extending inwards from the exterior side 184 of its panel and an outwardly-facing elongate ridge 194 adjacent to said channel, coupled to and integrally formed with said channel, and extending outwards from said exterior side of the panel in this example. Referring to FIG. 13, the side peripheral edge portions 188 and 190 of the corner panels 168, 170, 172, and 174 may thus be said to be corrugated at least in part in this example.

As seen in FIG. 1, each of the corner panels includes a lower peripheral edge portion 196 which forms part of and coincides with the lower peripheral edge portion 166 of the roof assembly 44. As seen in FIG. 21, the lower peripheral edge portions of the corner panels are generally corrugated in shape and include: a pair of spaced-apart, upwardly-facing, arcuate-shaped elongate channels 195 and 197, channels 195 of which are adjacent to, coupled to and integrally formed with the exterior sides 184 of the panels; a pair of spaced-apart, upwardly-facing, arcuate-shaped elongate ridges 199 and 201, ridges 199 of which are interposed between channels 195 and 197 and ridges 201 of which are adjacent to, integrally formed with and extend outwards from channels 197; a pair of spaced-apart, downwardly-facing, arcuate-shaped elongate channels 198 and 200 opposite said ridges 199 and 201, respectively; and a pair of spaced-apart, downwardly-facing, arcuate-shaped ridges 202 and 203 opposite said channels 195 and 197, respectively.

Channels 198 are shaped to align with, be adjacent to and face the interior 125 of the wall assembly 42. Channels 198 are shaped to receive the first set of rollers 130 and enable said rollers to rotate along said channels. As seen in FIG. 20, the horizontally-extending upper portions 108 of upper flanges 104 of the respective ones of the wall panels 70 extend along and are adjacent to the downwardly-facing ridges 202 and 203 and channels 198 in this example. Channels 200 are shaped to be adjacent to and face the exterior 127 of the wall assembly. Channels 200 are shaped to receive respective ones of the second set of rollers 128 and enable said rollers to rotate along said channels.

Figure 15:
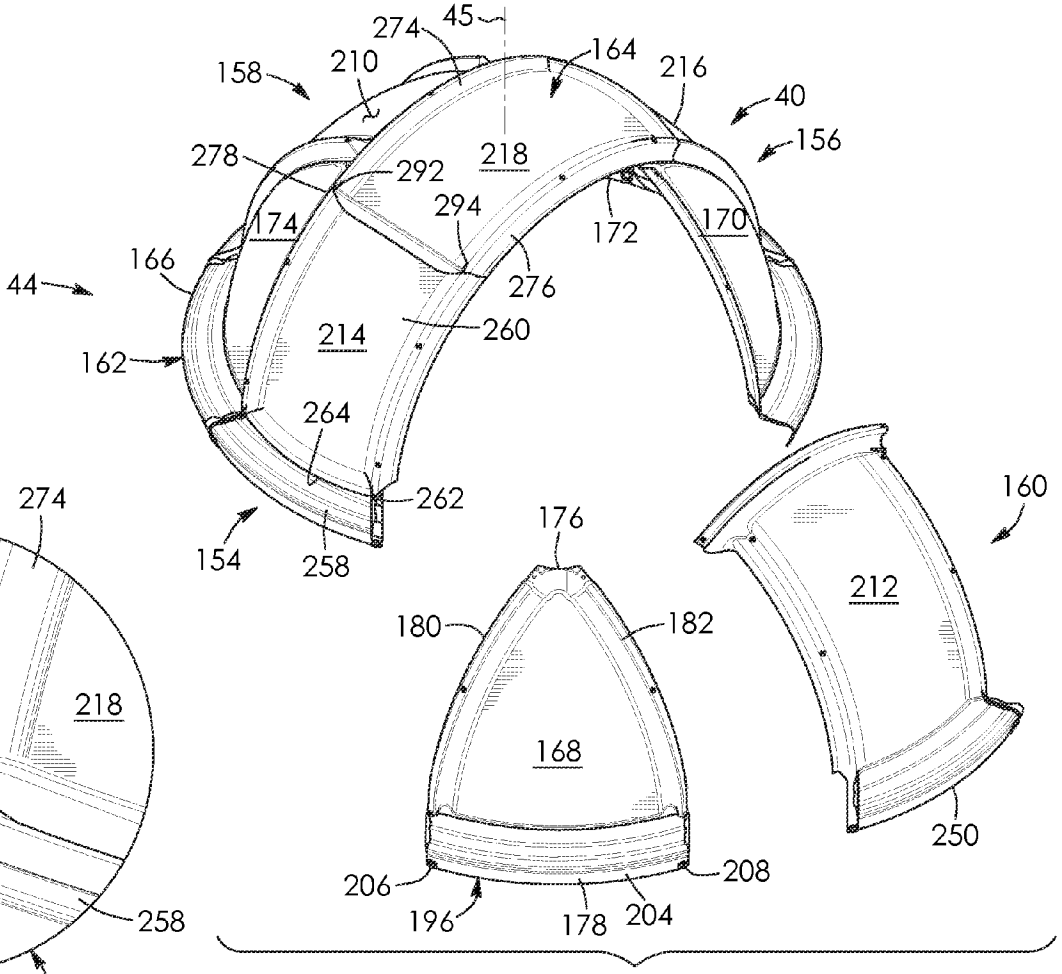
FIG. 15 is a top, front perspective, partially exploded view of the roof assembly similar to FIG. 14 with the roof assembly being shown in a more assembled state.
Figure 17:
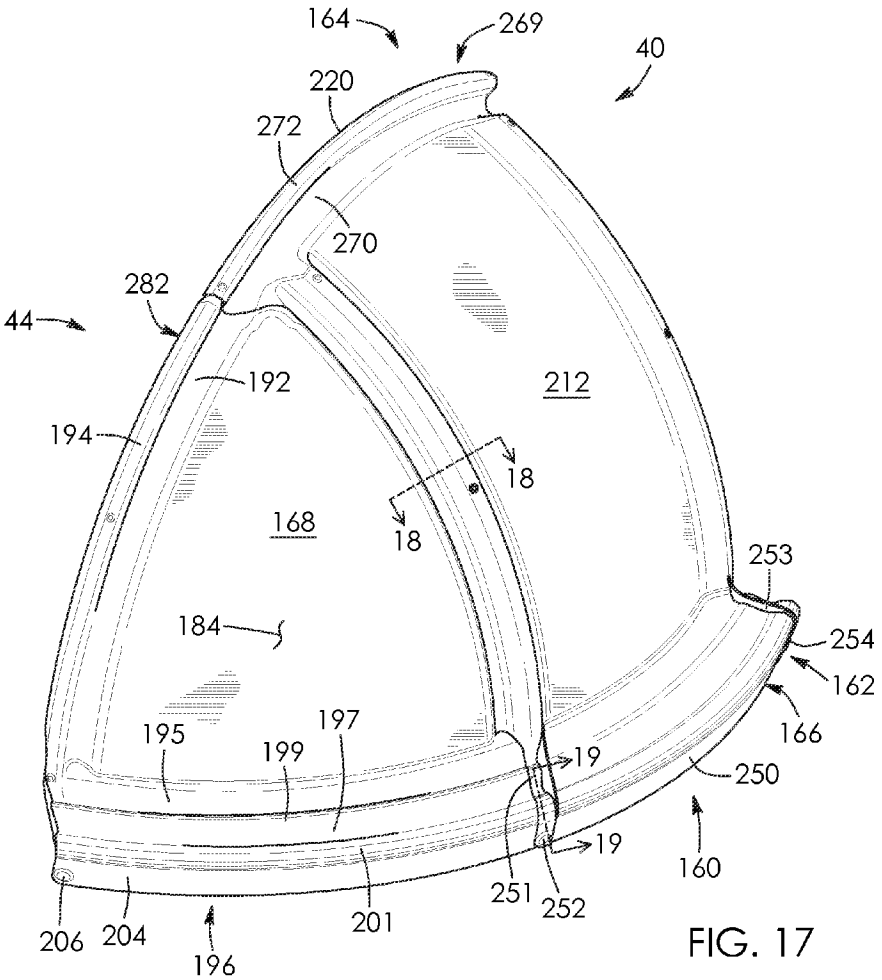
FIG. 17 is a top, side perspective view of a corner panel and a side panel of the roof assembly of FIG. 16 being shown in connected together.
Figure 19:
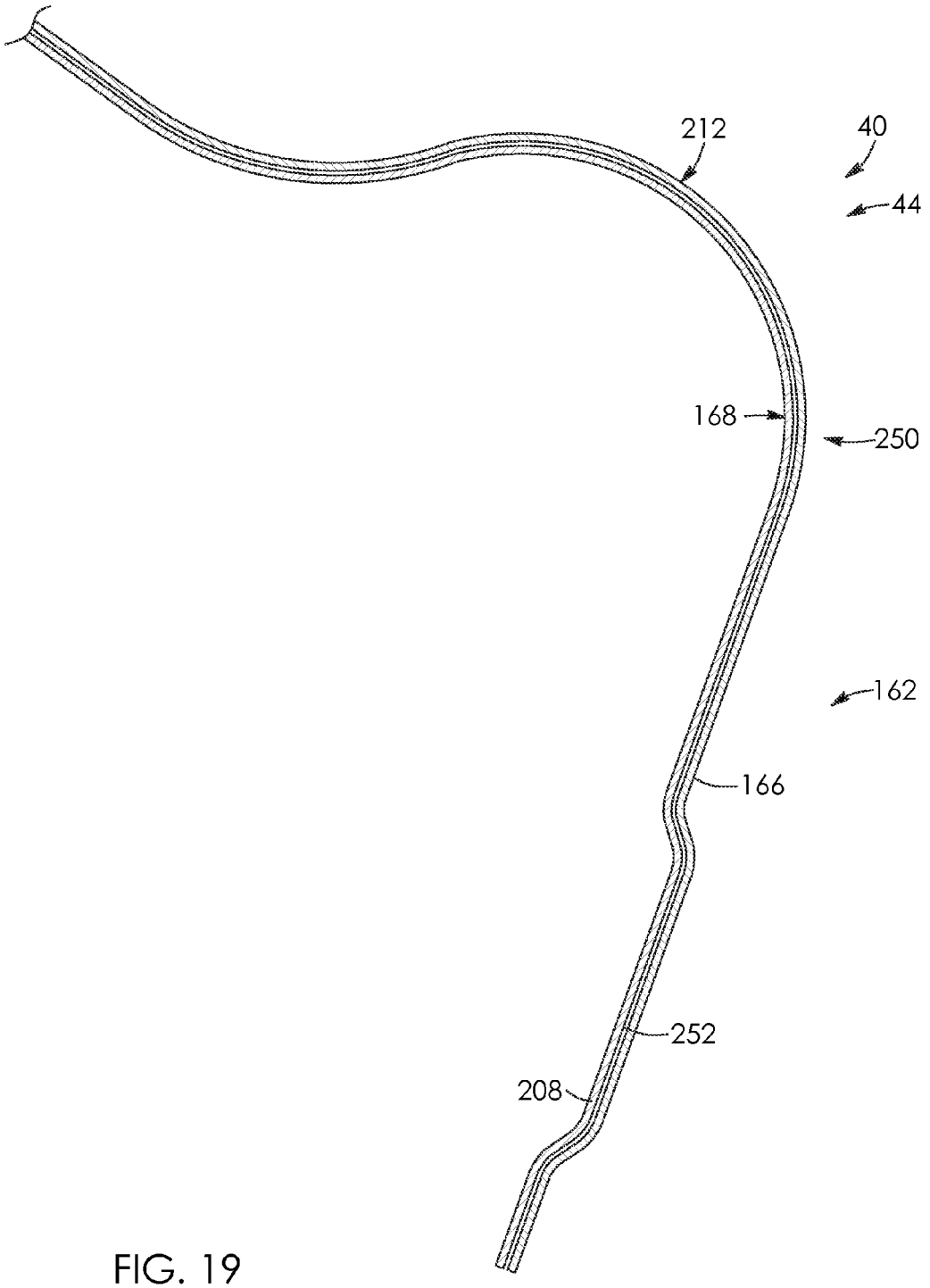
FIG. 19 is a cross-sectional view taken along lines 19-19 of FIG. 17 of the corner and side panel of FIG. 17.

As seen in FIG. 20, each of the lower peripheral edge portions 196 of the corner panels 168 includes an inwardly-angled lip 204 coupled to and angled downwards from channels 200. The lips are generally rectangular prisms in shape, are shaped to extend along the exterior 127 of the wall assembly 42 and be adjacent to and extend downwards relative to the upper peripheral edge portion 60 of the wall assembly. The downwardly-facing angled portions 110 of the flanges 104 of the respective ones of the wall panels 70 are extend adjacent to and face lips 204 in this example. As seen in FIG. 15, each of the lower peripheral edge portions 196 includes a pair of connector mechanisms, in this example in the form of a pair of spaced-apart protrusions 206 and 208 extending outwards from lips 204 at locations adjacent to sides 180 and 182, respectively, of the corner panels 168. As seen in FIGS. 17 and 19, the protrusions are generally circular in shape in this example.

Referring back to FIG. 13, the plurality of interengageable panels of the roof assembly 44 further includes a second set of panels comprising a pair of substantially identical side panels 210 and 212 and a front panel 214, a rear panel 216 and a top panel 218. These panels are generally curved, outwardly convex and rectangular in shape and similar in shape with each other in this example. The panels 210, 212, 214 and 216 have lengths L.2 and widths W.2 that are substantially equal in size to each other. Each of the panels is curved and outwardly convex in a direction extending along its width and curved and outwardly convex in a direction extending along its length.

Each of panels 210, 212, 214, and 216 has an elongate top, an elongate bottom which is spaced-apart from its top, and a pair of spaced-apart elongate sides which extend between said top and bottom, as shown by top 220, bottom 222 and sides 224 and 226 for panel 210. Each of the panels 210, 212, 214, 216 and 218 includes an exterior side and which is configured to face outwards, as shown by exterior side 228 for panel 210. Each of the panels has an interior side opposite its exterior side, with its interior side being configured to face within the interior 230 of the roof assembly 44, as seen by interior side 232 for panel 210 in FIG. 14. The exterior and interior sides of panels 210, 212, 214, 216 and 218 are substantially rectangular in shape in this example curved and outwardly convex along their lengths and widths. Referring to FIG. 13, the exterior and interior sides of panels 210, 212, 214 and 216 extend between their tops, bottoms and sides, as seen by exterior side 228 of panel 210 extending between the top 220, bottom 222 and sides 224 and 226 thereof.

Each of panels 210, 212, 214 and 216 includes a pair of spaced-apart side peripheral edge portions extending along their sides from the top to the bottom thereof, as seen by side peripheral edge portions 234 and 236 for panel 216 in FIG. 14. Each of the side peripheral edge portions of panels, as seen by panel 216 in FIG. 14, includes in this example: a pair of spaced-apart, longitudinally-curved, outwardly-facing channels 238 and 240, channels 238 of which are adjacent to and integrally formed with the exterior sides of the panels; a pair of spaced-apart, longitudinally-curved, downwardly-facing ridges 242 and 244 opposite said channels 238 and 240; a longitudinally-curved, outwardly-facing ridge 246 interposed between sides channels 238 and 240; and a longitudinally-curved, downwardly-facing channel 248 opposite said ridge 246. Referring to FIG. 1, the side peripheral edge portions of panels 212, 216, 210, and 214 are shaped to fit overtop of, interfit with and receive the side peripheral edge portions of corner panels 168, 170, 172 and 174, respectively. As seen in FIG. 18, downwardly-facing ridges 244 of respective ones of the panels 212 are shaped to be at least partially received within outwardly-facing channels 192 of respective ones of the panels 168. Outwardly-facing ridges 194 of respective ones of the panels 168 are shaped to be received by downwardly-facing channels 248 of respective ones of the panels 212. This manner of interfitting of panels is not strictly required and other manners of interfitting of the panels of the roof assembly 44 are possible in other embodiments.

Thus, in operation and referring to FIG. 14, corner panels 172 and 174 may first be positioned, with the side peripheral edge portions of panel 210 extending overtop of and interfitting with the side peripheral edge portions of said panels 172 and 174 thereafter. As seen in FIG. 15, side peripheral edge portions of panels 214 and 216 adjacent to corner panels 174 and 172 may thereafter extend overtop of and interfit with adjacent side peripheral edge portions of said panels 174 and 172, respectively. Side peripheral edge portions of corner panels 168 and 170 adjacent to panels 214 and 216 may thereafter be received by corresponding adjacent side peripheral edge portions of panels 214 and 216. Lastly, side peripheral edge portions of panel 212 may extend overtop of and interfit with adjacent respective side peripheral edge portions of corner panels 168 and 170.

As seen in FIG. 1, the roof panels 212, 170, 216, 172, 210, 174, 214 and 168 may thus be said to have peripheral edge portions shaped to interfit with each other so as to form a roof with a dome-like shaped when the roof panels are fully assembled.

Referring to FIG. 14, panels 210, 212, 214 and 216 each have a lower peripheral edge portion adjacent to their bottoms thereof, as shown by peripheral edge portion 250 for panel 212. As seen in FIGS. 17 and 19, each of the peripheral edge portions includes a pair of spaced-apart connector mechanisms, in this example in the form of recessed regions 252 and 254 shaped to receive and in this example selectively snap together with respective ones of the protrusions 208 of the corner panels 168. In this manner, panels 210, 212, 214 and 216 may selectively couple to corresponding adjacent ones of the corner panels. As seen in FIG. 17, each lower peripheral edge portions 250 of panels 210, 212, 214, and 216 also includes a pair of spaced-apart, upwardly-extending flanges 251 and 253 adjacent to said protrusions 206 and 208, respectively. Otherwise lower peripheral edge portions 250 of panels 210, 212, 214, and 216 are substantially similar in shape and function to the lower peripheral edge portions 196 of the corner panels 168. This thereby enables the sets of rollers 128 and 130, seen in FIGS. 20 and 21, to selectively rotate about channels 198 and 200 thereof. In this manner and referring to FIG. 1, the roof assembly 44 is thus selectively rotatable about its axis 45 and relative to wall assembly 42 as generally shown by arrow of numeral 256.

As seen in FIG. 1, the lips 204 of the respective lower peripheral edge portions of the panels 212, 170, 216, 172, 210, 174, 214 and 168 of the roof assembly 44 thus form an annular outer flange-like arrangement for directing rain and the like downwards and outwards from the interior 125 of the wall assembly 42.

Figure 3:
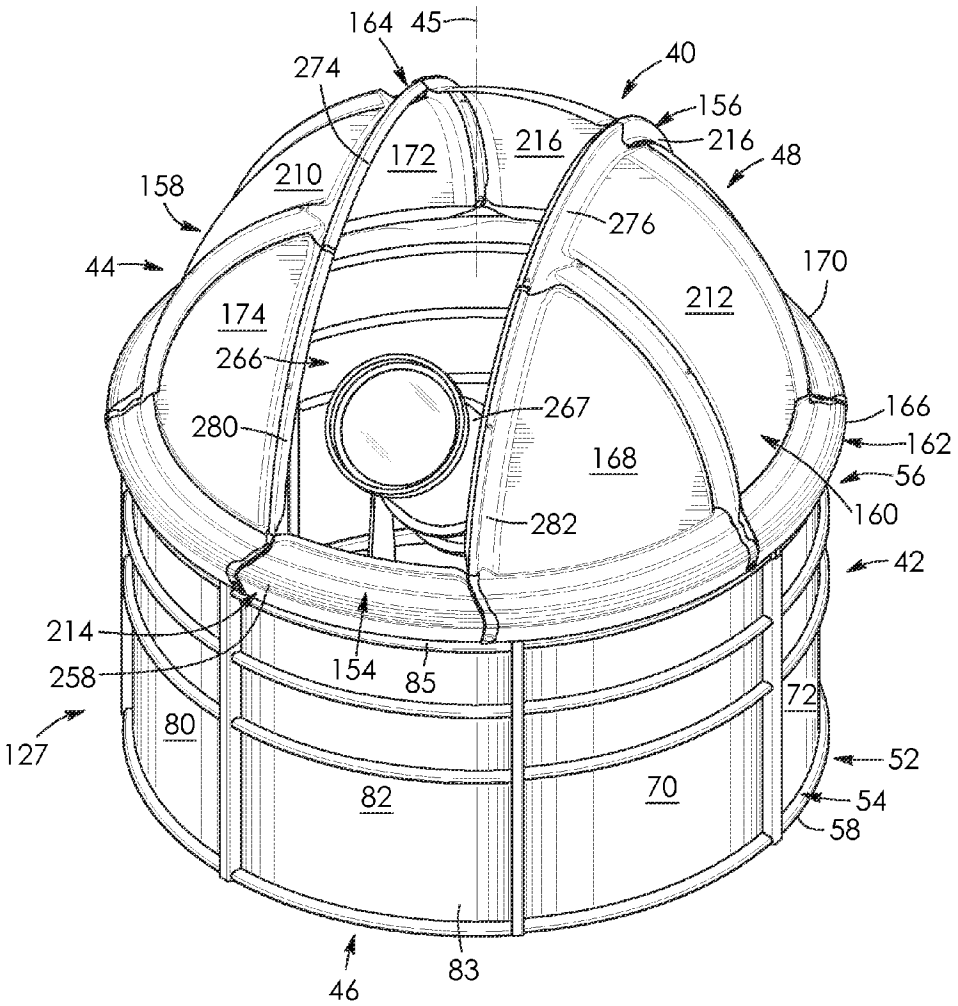
FIG. 3 is a top, front perspective view of the observatory similar to FIG. 2, with the top panel of the roof assembly being removed.
Figure 5:
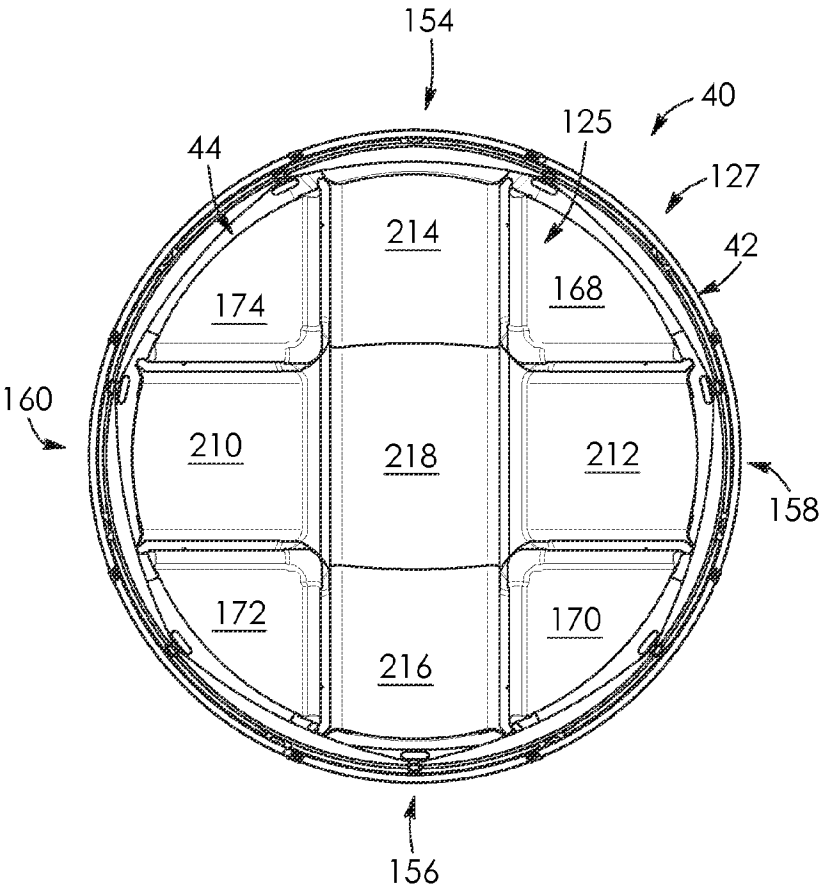
FIG. 5 is a bottom plan view thereof.
Figure 4:
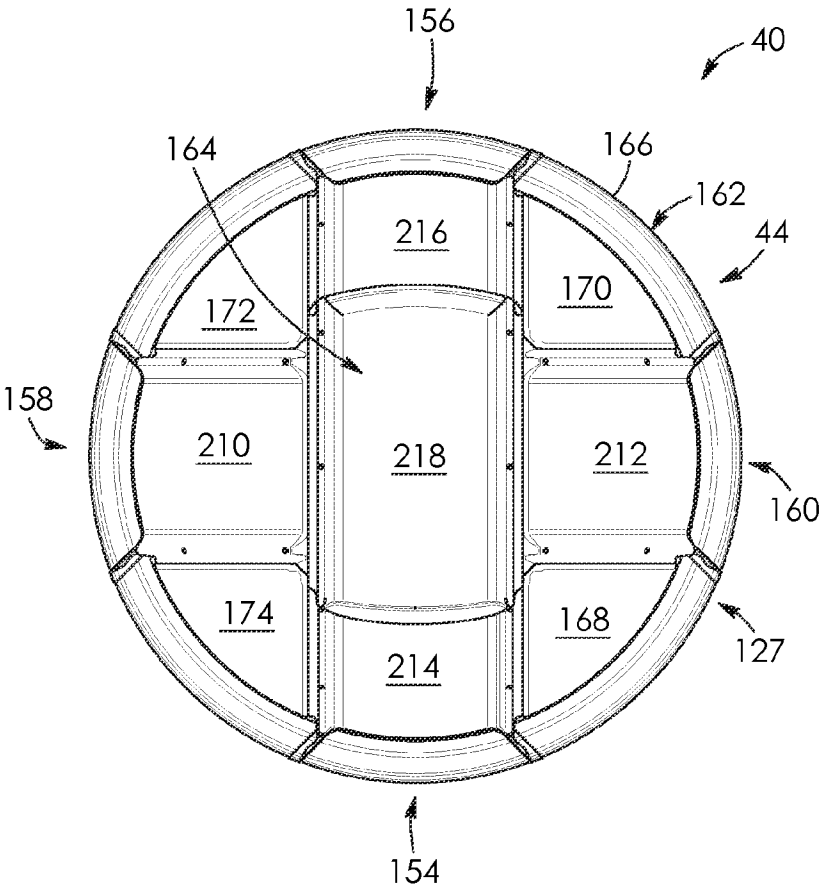
FIG. 4 is a top plan view of the observatory in the mode shown in FIG. 2 with its front panel included and its door panel closed.

Referring to FIG. 13, front panel 214 comprises two parts in this example: a lower part 258 essentially in the form of a lower peripheral edge portion such as portion 250 shown for panel 212, and an upper part 260. The lower part of the panel has an upper edge portion 262 shaped to selectively abut and receive a lower edge portion 264 of part 260, as seen in FIG. 15. In this manner, upper part 260 of panel 214 is selectively removeable, as shown in FIG. 3, to create an opening 266 through which a telescope 267 may view the stars. The elongate opening is selectively rotatable about the central axis 45 of the roof assembly 44. As seen in FIG. 13, the upper part 260 of panel 214 has an upper edge portion 268 spaced-apart from its lower edge portion 264.

Rear panel 216 is substantially the same in shape and parts as front panel 214 with the exception that the rear panel is a single integrally connected part in this example.

Side panels 210 and 212 have upper peripheral edge portions 269 at tops 220 thereof that are channel-shaped in this example, with each panel including an elongate, outwardly-facing and longitudinally-curved channel 270 adjacent to the exterior side 228 of the panel and an elongate, outwardly-facing and longitudinally-curved ridge 272 coupled to said channel. As seen in FIG. 17, the upper peripheral edge portions 269 of the side panels 210 and 212 are thus s-shaped in cross-section in this example. The side panels are shaped such that when their side peripheral edge portions interfit with respective adjacent peripheral edge portions of corner panels 168, ridges 194 and channels 192 of panels 168 align with ridges 272 and channels 270 of panels 212, respectively.

As seen in FIG. 3, the aligned ridges and channels of panels 172, 210 and 174 of the roof assembly 44 thus form an arcuate-shaped support 280 which is adjacent to and spaced-apart from side 160 of the roof assembly 44 and which extends from the front 154 to the rear 156 of the assembly 44. As seen in FIG. 2, the aligned ridges and channels of panels 168, 212 and 170 similarly form a further arcuate-shaped support 282 spaced-apart from support 280. Support 282 is adjacent to and spaced-apart from side 160 of the roof assembly and extends from the front to the rear of the assembly. Each of the supports thus includes a ridge or ridge-shaped portion which is outwardly convex and a channel-shaped portion adjacent thereto and is thus s-shaped in cross-section in this example.

Figure 16:
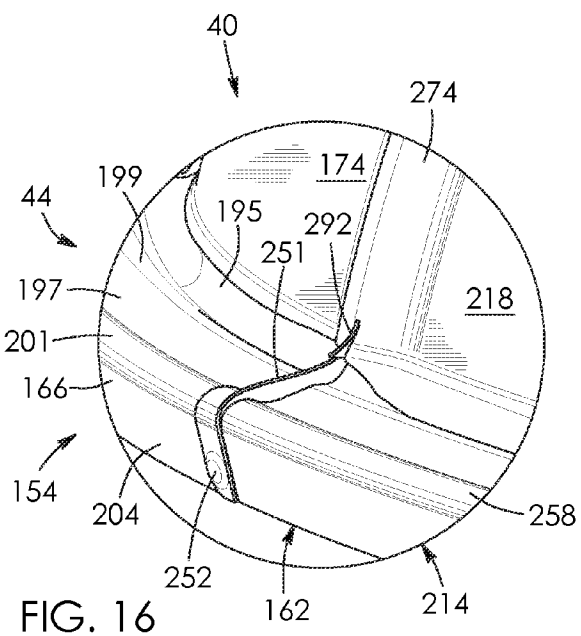
FIG. 16 is an enlarged fragmented view of the top panel of the roof assembly shown in a lower position together with a lower part of the front panel and a corner panel of the roof assembly being partially shown.

Referring back to FIG. 13, top panel 218 has a pair of spaced-apart side peripheral edge portions 274 and 276 that are channel-shaped in this example. Each side peripheral edge portion includes an elongate, downwardly-facing and longitudinally-curved channel, as shown by channel 278 for side peripheral edge portion 274, which is shaped to extend overtop of and interfit with respective ones of the ridges 272 of the side panels 210 and 212. Referring to FIG. 2, the side peripheral edge portions 274 and 276 of the top panel 218 are shaped such that the panel is selectively moveable along supports 280 and 282, as generally shown by arrow of numeral 284. This may thereby enable positioning of the opening 266 to be moveable. Referring back to FIG. 13, the top panel 218 has a front peripheral edge portion 286 and a rear peripheral edge portion 288 which is spaced-apart therefrom. As seen in FIG. 1, the rear peripheral edge portion of panel 218 is shaped to align with, abut and extend overtop of the upper peripheral edge portion 290 of rear panel 216. As seen in FIG. 2, the front peripheral edge portion 286 of panel 218 extends outwards from its exterior side 228. The front peripheral edge portion of the panel includes a pair of spaced-apart outwardly-extending protrusions 292 and 294 which are triangular in shape in this example and which align adjacent to respective ones of the side peripheral edge portions 274 and 276 of the panel. As seen with reference to FIGS. 15 and 16, when front panel 214 seen in FIG. 15 is removed, top panel 218 is moveable from an upper position at the top 164 of the roof assembly 44 to a lower position at the front 154 of the roof assembly as shown in FIG. 16. In its lower position and as seen in FIG. 16, respective ones of the protrusions are shaped to extend radial outwards and at least partially abut respective ones of flanges 251 in this example.

Referring to FIG. 1, the roof assembly 44 is thus shaped such that central ones 214, 218 and 216 of the panels are selectively removeable from arcuate-shaped supports 280 and 282 seen in FIG. 2 to form an elongate opening in the roof assembly, as seen by opening 266 in FIG. 2. Referring to FIG. 1, the panels of the roof assembly are further shaped such that other ones 212, 218 and 210 of the panels are selectively removable to form an alternative or second elongate opening (not shown) extending through the roof assembly and which is perpendicular to the first elongate opening for this example.

According to one aspect, there is thus provided an unassembled modular observatory kit 43 seen in FIGS. 10 and 13. As seen in FIG. 10, the kit includes a plurality of interengageable wall panels 70, 72, 74, 76, 78, 80, and 82, posts 61, 62, 63, 64, 65, 66 and 67, a first set of rollers 128 and a second set of rollers 130. As seen in FIG. 13, the kit 43 further includes a plurality of interengageable roof panels, including a plurality of corner panels 168, 170, 172 and 173, side panels 210 and 212, a front panel 214, a rear panel 216 and a top panel 218.

ADDITIONAL DESCRIPTION

Examples of modular observatories have been described. The following clauses is offered as further description.

(1) A modular observatory comprising a plurality of panels having engagement means for selectively connecting together.

It will be appreciated that many variations are possible within the scope of the invention described herein. For example, the roof assembly 44 is described as having lower peripheral edge portions shaped to receive rollers which are rotatably connected to the wall assembly 42. In an alternative embodiment, the rollers may rotatably couple to the roof assembly and the wall assembly may have channels at the upper peripheral edge portion thereof shaped to receive said rollers.

In a further embodiment, rollers are not strictly required and the roof assembly may be slidably engageable with the wall assembly for example.

It will be further understood by someone skilled in the art that many of the details provided above are by way of example only and are not intended to limit the scope of the invention which is to be determined with reference to at least the following claims.

What is claimed is:

1. A modular observatory comprising:

an annular wall assembly and a roof assembly selectively engageable with the wall assembly, the roof assembly having a front, a rear opposite the front, and opposite sides interposed between the front and rear thereof, each of the assemblies including a plurality of interengageable panels, the panels of the wall assembly being generally curved and rectangular, a set of the panels of the roof assembly being generally curved and rectangular in shape, and peripheral edge portions of some of the panels of the roof assembly forming a pair of spaced-apart arcuate-shaped supports which extend from the front to the rear of the roof assembly, the supports being inwardly spaced-apart from the sides of the roof assembly, each of the supports being at least in part outwardly convex in lateral cross-section.

2. The observatory as claimed in claim 1 wherein the panels of the wall assembly are similar in shape to each other and wherein the panels of the roof assembly are similar in shape to each other.

3. The observatory as claimed in claim 1 wherein a further set of the panels of the roof assembly are generally curved and triangular in shape.

4. The observatory as claimed in claim 1 wherein the roof assembly is rotatable relative to the wall assembly.

5. The observatory as claimed in claim 1 wherein the roof assembly has a lower peripheral edge portion and wherein the wall assembly has an upper peripheral edge portion which is in interfitted engagement with the lower peripheral edge portion of the roof assembly.

6. The observatory as claimed in claim 1 wherein the wall assembly has an upper peripheral edge portion and wherein the roof assembly has a lower peripheral edge portion which is channel-shaped and configured to receive the upper peripheral edge portion of the wall assembly.

7. The observatory as claimed in claim 1, wherein each of the supports includes a ridge-shaped portion which is outwardly convex in lateral cross-section and includes a channel-shaped portion adjacent thereto, wherein central ones of the panels of the roof assembly which are spaced-apart from the sides of the roof assembly have peripheral edge portions configured to interfit with said supports, and wherein at least some of said central ones of the panels of the roof assembly are selectively removable to form an elongate opening extending through the roof assembly.

8. The observatory as claimed in claim 1 wherein each of the panels has a length and a width, and wherein the panels of the roof assembly are curved in directions extending along the widths thereof and curved in directions extending along the lengths thereof.

9. The observatory as claimed in claim 1 wherein each of the panels has a length and a width, wherein the panels of the wall assembly are curved in directions extending along the widths thereof, and wherein the panels of the roof assembly are curved in directions extending along the widths thereof and curved in directions extending along the lengths thereof.

10. The observatory as claimed in claim 1, wherein the wall assembly further includes a plurality of circumferentially spaced-apart elongate upright members, the panels of the wall assembly extending between and abutting said upright members, a first set of rollers rotatably connecting to top ends of said upright members and a second set of rollers rotatably connecting to upper peripheral edge portions of the panels of the wall assembly, the second set of rollers having axes of rotatation that extend outwards and downwards, and wherein the roof assembly has a lower peripheral edge portion which includes a pair of spaced-apart downwardly-facing, annular channels shaped to receive said rollers therein, the roof assembly being rotatable relative to the wall assembly.

11. The observatory as claimed in claim 1, wherein the roof assembly rotatably connects to the wall assembly.

12. The observatory as claimed in claim 1, wherein the roof assembly has an elongate opening extending therethrough, has a vertically-extending central axis and rotatably connects to the wall assembly, positioning of the elongate opening being selectively adjustable about said central axis.

13. The observatory as claimed in claim 12 wherein the elongate opening is positioned between said sides of the roof assembly.

14. The observatory as claimed in claim 1, wherein a further set of the panels of the roof assembly are similar in size and curved and triangular in profile.

15. A modular observatory comprising:

an annular wall assembly and a roof assembly selectively engageable with the wall assembly, the roof assembly having opposite sides, each of the assemblies including a plurality of interengageable panels, the panels of the wall assembly being generally curved and rectangular, wherein a set of the panels of the roof assembly are generally curved and rectangular in shape, wherein peripheral edge portions of some of the panels of the roof assembly form a pair of spaced-apart arcuate-shaped supports which extend from a first to a second of the sides of the roof assembly, the supports being s-shaped in cross-section, wherein central ones of the panels of the roof assembly have peripheral edge portions that are s-shaped in cross-section, the central ones of the panels of the roof assembly being configured to interfit with said supports, and wherein at least some of said central ones of the panels of the roof assembly are selectively removable to form an elongate opening extending through the roof assembly.

16. The observatory as claimed in claim 15, wherein the wall assembly further includes a plurality of circumferentially spaced-apart elongate upright members, the panels of the wall assembly extending between and abutting said upright members, a first set of rollers rotatably connecting to top ends of said upright members and a second set of rollers rotatably connecting to upper peripheral edge portions of the panels of the wall assembly, the second set of rollers having axes of rotatation that extend outwards and downwards, and wherein the roof assembly has a lower peripheral edge portion which includes a pair of spaced-apart downwardly-facing, annular channels shaped to receive said rollers therein, the roof assembly being rotatable relative to the wall assembly.

17. The observatory as claimed in claim 15 wherein the roof assembly rotatably connects to the wall assembly.

18. The observatory as claimed in claim 15, wherein a further set of the panels of the roof assembly are similar in size and curved and triangular in profile.

19. A modular observatory comprising:

an annular wall assembly and a roof assembly selectively engageable with the wall assembly, the wall assembly having an upper peripheral edge portion and the roof assembly having a lower peripheral edge portion, each of the assemblies including a plurality of interengageable panels, the panels of the wall assembly being generally curved and rectangular, and a set of the panels of the roof assembly being generally curved and rectangular in shape; and a plurality circumferentially spaced-apart rollers rotatably connected to the peripheral edge portion of a first one of the assemblies, and wherein the peripheral edge portion of a second one of the assemblies being channel-shaped to receive said rollers, the roof assembly being rotatable relative to the wall assembly thereby.

20. The observatory as claimed in claim 19, wherein the roof assembly has opposite sides, a front, a rear, a bottom and a top, the front and the rear of the roof assembly extending between said sides thereof, the front, rear and sides of the roof assembly extending from the bottom towards the top thereof, and wherein the panels of the roof assembly, the panels of the roof assembly being shaped such that selective ones of the panels of the roof assembly are removeable to form an elongate opening in the top of the roof assembly which extends from the front towards the rear thereof and between the sides thereof.

* * * * *

UNITED STATES PATENT AND TRADEMARK OFFICE

CERTIFICATE OF CORRECTION

PATENT NO. : 9,315,983 B1
APPLICATION NO. : 14/739794
DATED : April 19, 2016
INVENTOR(S) : Babak Sedehi It is certified that error appears in the above-identified patent and that said Letters Patent is hereby corrected as shown below:

In the Claims

Claim 19 and 20 should read

19. A modular observatory comprising:

an annular wall assembly and a roof assembly selectively engageable with the wall assembly, the wall assembly having an upper peripheral edge portion and the roof assembly having a lower peripheral edge portion, each of the assemblies including a plurality of interengageable panels, the panels of the wall assembly being generally curved and rectangular, and a set of the panels of the roof assembly being generally curved and rectangular in shape; and a plurality circumferentially spaced-apart rollers rotatably connected to the peripheral edge portion of a first one of the assemblies, the peripheral edge portion of a second one of the assemblies being channel-shaped to receive said rollers and the roof assembly being rotatable relative to the wall assembly thereby.

20. The observatory as claimed in claim 19, wherein the roof assembly has opposite sides, a front, a rear, a bottom and a top, the front and the rear of the roof assembly extending between said sides thereof, the front, rear and sides of the roof assembly extending from the bottom towards the top thereof, and wherein the panels of the roof assembly are shaped such that selective ones of the panels of the roof assembly are removeable to form an elongate opening in the top of the roof assembly which extends from the front towards the rear thereof and between the sides thereof.

Signed and Sealed this
Twenty-eighth Day of June, 2016

Michelle K. Lee

Michelle K. Lee
*Director of the United States Patent and Trademark Office*